United States Patent [19]

Tucker et al.

[11] 3,937,231

[45] Feb. 10, 1976

[54] HAIR DRYER

[75] Inventors: James E. Tucker; Jay Doblin, both of Chicago, Ill.

[73] Assignee: The Gillette Company, Boston, Mass.

[22] Filed: Oct. 9, 1973

[21] Appl. No.: 404,194

Related U.S. Application Data

[63] Continuation of Ser. No. 166,550, July 27, 1971, abandoned.

[52] U.S. Cl. ..... 132/11 A; 34/91

[51] Int. Cl.[2] ..... A45D 24/00

[58] Field of Search ..... 132/9, 111, 112, 11; 15/4, 15/400; 219/370; 34/97, 91, 243 R

[56] References Cited

UNITED STATES PATENTS

| | | | |
|---|---|---|---|
| 1,597,855 | 8/1926 | Zahorsky | 15/400 |
| 3,348,020 | 10/1967 | Cooper | 219/370 |
| 3,613,257 | 10/1971 | Yashiike et al. | 34/91 |
| 3,702,616 | 11/1972 | Mercer | 132/9 |

*Primary Examiner*—G. E. McNeill

[57] ABSTRACT

A portable hair dryer which includes an air inlet and air outlet and a rotor for drawing air through the dryer in combination with a comb detachably secured to the dryer housing. Cooperative means on the comb and dryer housing for detachably securing the comb includes bars on the comb which are spaced apart both horizontally and vertically from the comb back and extends on opposite sides thereof and slots in the housing which extend longitudinally thereof in which the bars are longitudinally slidable.

3 Claims, 6 Drawing Figures

HAIR DRYER

This is a continuation of application Ser. No. 166,550, filed July 27, 1971 now abandoned.

The present invention relates to portable hair dryers.

It is a principal object of the invention to provide such a hair dryer which has improved safety characteristics when used in close proximity to the hair and which provides for more rapid drying of the hair.

According to the invention, a portable hair dryer is provided which comprises a dryer housing suitable to be held in the palm of the hand. The housing defines an air inlet and air outlet, and disposed within the housing is a bladed cylindrical rotor for drawing a stream of air into the air inlet, through the dryer housing and out through the air outlet. A comb is detachably secured to the dryer housing with its teeth extending beyond the air outlet in the direction of the stream of air. In its preferred form the comb includes a back, a plurality of teeth extending from the back, and at least two clamp members engageable with recesses in opposite sides of the dryer housing adjacent the air outlet. The clamp members may comprise two generally parallel bars connected to the back by a plurality of resilient ribs and the back may have a tear-drop shaped, or airfoil, cross section. It is also preferred that the air inlet be provided with a mesh screen mounted immediately inside the dryer housing, whereby foreign objects are excluded from contact with the rotor.

Other objects, features, and advantages of the invention will appear from the following description of a preferred embodiment. In the drawings.

Figure 1:
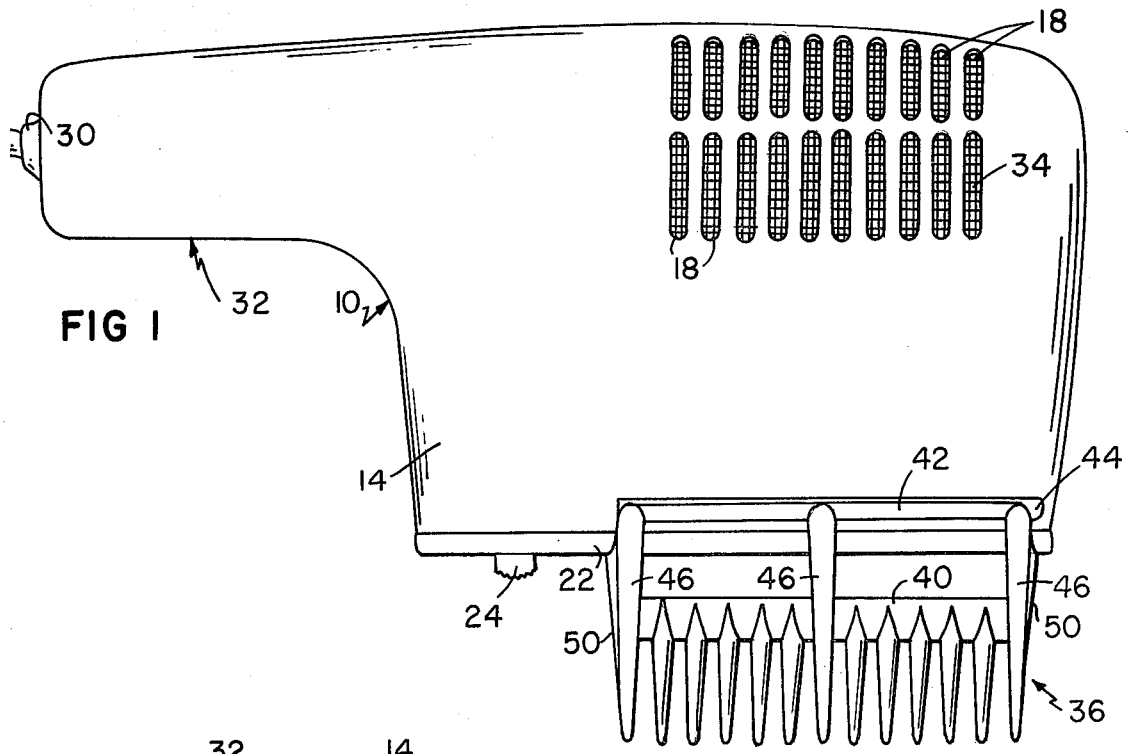
FIG. 1 is a plan view of a hair dryer according to the invention.

Referring to the drawings, the hair dryer includes a dryer housing 10 which is preferably made of plastic and comprises separable portions 14 and 16 which are held together by means of screws (not shown). The housing defines an air inlet in the form of a series of elongated slots 18 in the portion 14 of the housing 10. An air outlet 20 is provided in the lower end of the hair dryer as seen in FIG. 1. A protective grill 22 (FIG. 2) is mounted over the opening of the air outlet, by means of screws 23, to protect the user from injury during operation of the dryer. A three position switch 24 is also provided. The operation of switch 24 will be understood in connection with the description of the circuit diagram of FIG. 6.

Blower means are provided within the housing 10 for drawing a stream of air into the air inlet, through the dryer housing and forcing it out of the air outlet. As shown best in FIG. 3, the blower means may comprise a tangential fan 26 of cylindrical form having a plurality of blades 28 which are generally parallel to the cylindrical axis. Fan 26 is mounted for rotation directly below the air inlet slots 18. A channel is provided within the housing 10 which extends between the fan 26 and the air outlet 20. Electrical air heating means (described below with relation to FIG. 6) may be positioned in the channel. An electrical power cord 30 extends from the end of a handle portion 32 of the housing 10.

Figure 3:
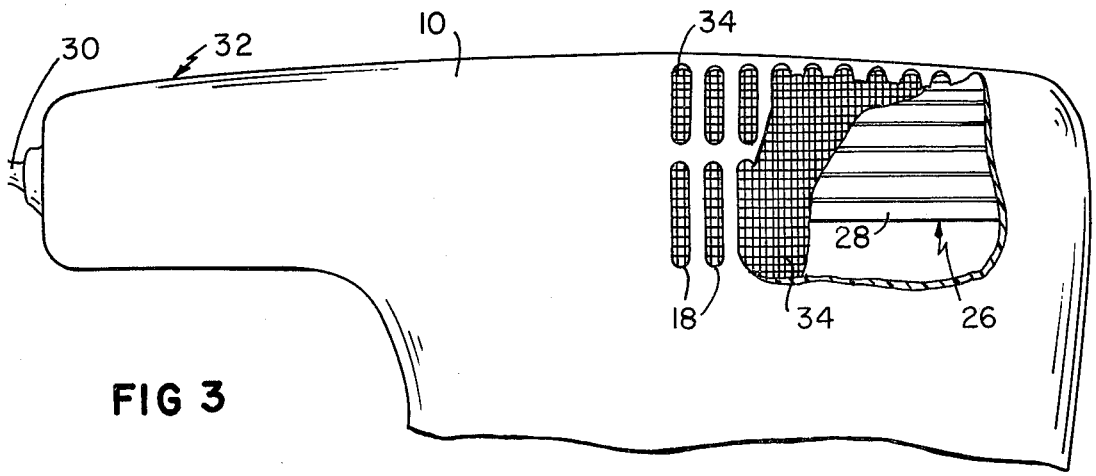
FIG. 3 is a view similar to FIG. 1 in which portions of the hair dryer have been broken away to reveal details of its construction.
Figure 4:
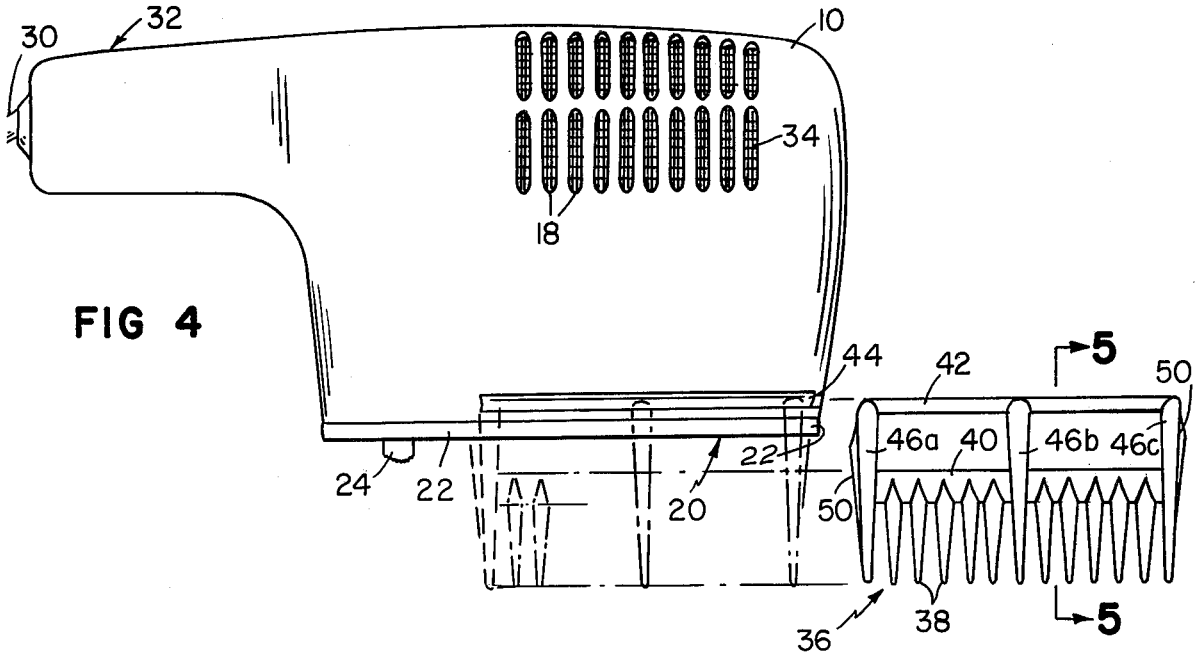
FIG. 4 is a view similar to that of FIG. 1 showing the comb portion of the hair dryer in a detached position.

As best seen in FIG. 3, a fine mesh screen 34 such as conventional insect screening is mounted within the housing 10 extending across the entire region of the air inlet slots 18. Such a screen may conveniently be attached to the inner surface of the upper portion 14 in any conventional fashion.

Figure 2:
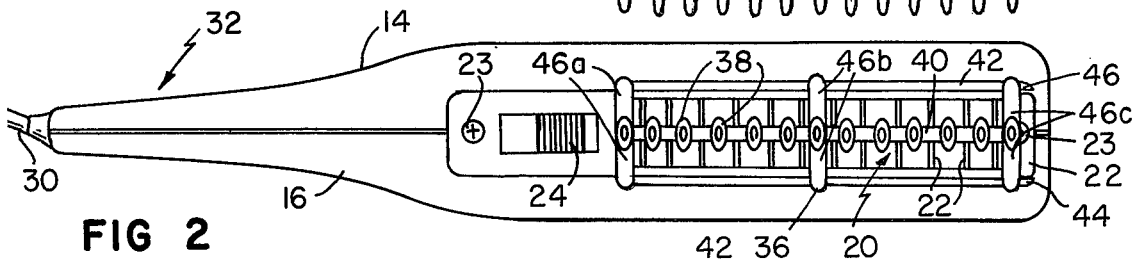
FIG. 2 is a view taken from the bottom of FIG. 1.
Figure 5:
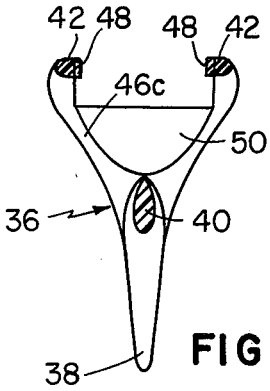
FIG. 5 is a view taken at 5—5 of FIG. 4.

A comb 36 is mounted over the air outlet 20 so as to have its teeth 38 aligned with the general direction of air flow from the outlet 20 (i.e., perpendicular to grill 22). The comb 36 includes a plurality of teeth 38 which preferably taper in a direction away from the air outlet 20. The teeth extend from a back member 40 which is preferably tear-drop shaped, or airfoil, in cross section with the pointed end facing the air outlet 20. This configuration provides for a smooth flow of air to both sides of the comb's teeth 38. A pair of parallel bars or clamps 42 are provided for engagement with elongated recesses or slots 44 in the surface of dryer housing 10 adjacent to, and generally parallel with, the air outlet 20 on opposite sides of the housing. The bars 42 are connected to the back member 40 by means of a plurality of ribs 46. The ribs 46 are preferably paired as best seen in FIGS. 2 and 5. The embodiment illustrated includes three pairs of ribs, those pairs being identified by the reference numbers 46a, 46b, and 46c. The ribs (as well as the entire comb 36) are preferably made from stiff but resilient plastic material and sized so that opposed surfaces 48 of bars 42, in the relaxed configuration of the comb, are spaced apart a distance which is slightly less than the distance between the recesses 44. With this arrangement the comb 36 may be easily attached or removed from the dryer and yet is firmly retained in position by resiliently clamping the walls of the opposing recesses while the dryer is being used. Walls 50 are provided between the ribs at the ends of the comb (i.e., ribs **46*a* and 46*c*) to assist in channeling the air from the air outlet 20** along the comb's teeth.

Figure 6:
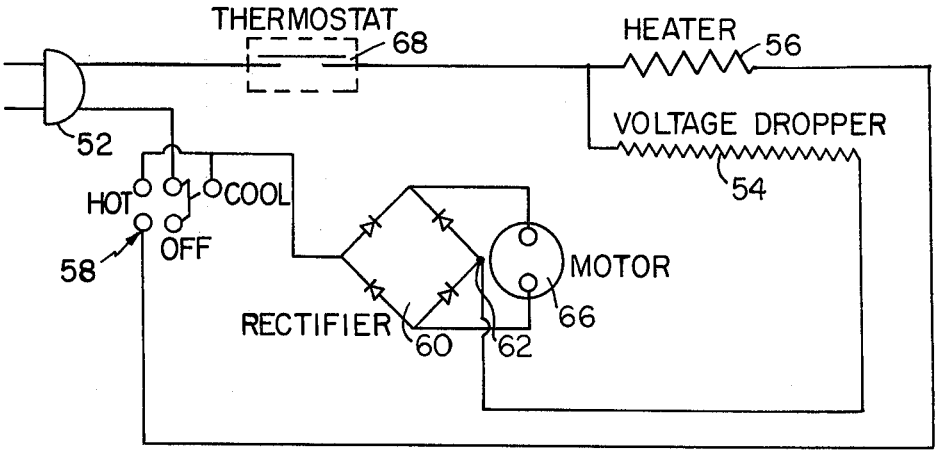
FIG. 6 is a circuit diagram for the hair dryer of FIG. 1.

Referring to the electrical circuit diagram of FIG. 6, a power cord 52 supplies power to a voltage dropper 54 (and heater 56 if switch 58 is in the "HOT" position). Rectifier 60 is supplied at its opposite input terminals 62 and 64 from the voltage dropper and the other line of the power cord. Motor 66 is supplied from the rectifier and is connected in a conventional fashion to rotate the blower means described above. Thermostat 68 is located within the dryer housing 10 and opens the circuit to protect the dryer if overheating occurs. The heater 56 preferably comprises resistance coils which are positioned in the channel leading from the blower 26 to the air outlet 20.

In operation, the hand held hair dryer may be used with or without comb 36 in close proximity to the hair without fear of the hair being drawn through the air inlet into contact with the rotor 26, because of the protective screen 34. It has been found that by use of the comb 36, with drying air being supplied to flow along the teeth 38, more rapid drying of the hair is accomplished.

It is also contemplated that a variety of combs 36 may be provided, each having a different fineness, i.e., different spacing between adjacent teeth. With the comb structure and attachment technique described above, exchange of combs becomes a simple matter.

Other embodiments of the invention will occur to those skilled in the art and are within the following claims.

What is claimed is:

1. A portable hair dryer comprising in combination a dryer housing, said housing defining an air inlet and defining a single air outlet of generally rectilinear shape and of greater length than width, said housing including therein blower means disposed within the housing for drawing a stream of air into the air inlet, through said dryer housing and out of said outlet, said blower means being aligned with said outlet to cause said stream of air to pass directly from said blower means through said outlet without change of direction; a comb of generally rectilinear shape having a length substantially equal to the length of said outlet and a thickness substantially less than the width of said outlet and being provided with a back and spaced teeth projecting in one direction from said back; and cooperative means on said comb and said housing for demountably attaching said comb to said housing with the teeth of said comb facing away from the housing generally parallel to the direction of air flow from said outlet, with the back of said comb spaced beyond the mouth of said outlet and exposed thereto, and with said comb located within the air stream from said outlet, said cooperative means including bars resiliently supported on said comb and spaced apart both longitudinally and vertically beyond opposite sides of said comb back and extending parallel with said back, and retainer means on said housing at opposite sides of the mouth of said outlet for detachably engaging said bars at the sides thereof toward said comb back.

2. The hair dryer of claim 1 wherein said retainer means comprise slots in said housing extending longitudinally thereof in which said bars are longitudinally slidable.

3. The hair dryer of claim 2 wherein said bars are supported by resilient ribs spaced longitudinally of the comb and connected thereto and to said bars, said ribs extending outwardly of the sides of the comb and beyond the back thereof to the points of connection thereof with said bars.

* * * * *